US005697116A

United States Patent [19]

Loferer

[11] Patent Number: 5,697,116

[45] Date of Patent: Dec. 16, 1997

[54] DEVICE FOR CLEANING AND ACCELERATING GLOBULAR OBJECTS, ESPECIALLY GOLF BALLS

[76] Inventor: Georg Loferer, Am Krautgarten 2a, D-81243 Munich, Germany

[21] Appl. No.: 500,926

[22] PCT Filed: Oct. 14, 1994

[86] PCT No.: PCT/DE94/01221

§ 371 Date: Mar. 11, 1996

§ 102(e) Date: Mar. 11, 1996

[87] PCT Pub. No.: WO95/11064

PCT Pub. Date: Apr. 27, 1995

[30] Foreign Application Priority Data

| | | | |
|---|---|---|---|
| Oct. 17, 1993 | [DE] | Germany | 9315651 U |
| Nov. 10, 1993 | [DE] | Germany | 9317192 U |
| Jan. 19, 1994 | [DE] | Germany | 44 01 462.7 |

[51] Int. Cl.[6] ..... A63B 47/04; B08B 1/02

[52] U.S. Cl. ..... 15/21.2; 15/302; 15/308; 15/409; 406/153

[58] Field of Search ..... 15/3.1, 3.12–3.16, 15/3.21, 21.2, 88.1, 308, 409, 302; 406/153

[56] References Cited

U.S. PATENT DOCUMENTS

| | | | |
|---|---|---|---|
| 1,702,203 | 2/1929 | Day | 15/21.2 |
| 2,217,256 | 10/1940 | McCauley | 15/21.2 |
| 3,820,183 | 6/1974 | Gustafson et al. | 15/21.2 |
| 3,918,116 | 11/1975 | Valdespino | 15/3.13 |
| 4,181,996 | 1/1980 | Hollrock | 15/21.2 |
| 5,139,577 | 8/1992 | Brock | 15/21.2 X |
| 5,228,168 | 7/1993 | Hollrock et al. | 15/308 X |

FOREIGN PATENT DOCUMENTS

| | | | |
|---|---|---|---|
| 2552725 | 6/1977 | Germany . | |
| 882490 | 11/1981 | U.S.S.R. | 15/3.1 |
| 1189461 | 11/1985 | U.S.S.R. . | |

*Primary Examiner*—Mark Spisich

[57] ABSTRACT

The invention generally relates to a device for cleaning and accelerating objects which are globular. In particular the invention relates to a device for cleaning golf balls with a high throughput of balls. Devices of this kind are mainly used on golf courses for practice operations as for that purpose, on the one hand, a great number of golf balls is used and, on the other hand, the balls get dirty when they touch the soil or have contact with very short grass residues, which result from the cutting of the greens. Especially the dirt sticking between the dimples of the golf balls, which might dry and become hard, leads to an extremely negative influence on the flight properties of the golf balls. In order to guarantee smooth and economic practice operations, a device of this kind must ensure a high degree of cleaning power as well as a high throughput of balls.

1 Claim, 2 Drawing Sheets

DEVICE FOR CLEANING AND ACCELERATING GLOBULAR OBJECTS, ESPECIALLY GOLF BALLS

BACKGROUND OF THE INVENTION

1. Field of the Invention

The present invention relates to a device for cleaning and accelerating globular objects. In particular, the invention relates to a device for cleaning golf balls with a high throughput of balls.

2. Description of the Prior Art

In the prior art, several arrangements for cleaning and transporting globular objects have been devised. For example:

U.S. Pat. No. 5,139,577
U.S. Pat. No. 5,228,168
U.S. Pat. No. 4,181,996
U.S. Pat. No. 3,820,183
U.S. Pat. No. 3,918,116
U.S. Pat. No. 2,217,256
USSR Patent No. 882-490

Except for the U.S. Pat. No. 3,918,116 and USSR 882-490, devices of this kind are mainly used on golf courses for practice operations as for that purpose, on the one hand, a great number of golf balls is used and, on the other hand, the balls get dirty when they touch the soil or have contact with very short grass residues, which result from the cutting of the greens. Especially the dirt sticking between the dimples of the golf balls, which might dry and become hard, leads to an extremely negative influence on the flight properties of the golf balls.

In order to guarantee smooth and economic practice operations, a device of this kind must ensure a high degree of cleaning power as well as a high throughput of balls.

A device for cleaning golf balls is described, for example, in the U.S. Pat. No. 4,181,996. The known device has a round brush attached to a roller. Around the brush there is a metal band, the flat side of which is aligned parallel to the axis of the brush, and this metal band is arranged helically so that it is possible to lead the golf balls along the brush roller. The drive of the roller, e.g. a motor, drives the golf balls in the guiding device along the brush roller, thus cleaning the balls. The cleaning process can be supported by adding water, for example.

With such a conventional device the soiling, which has been caused by contact with the soil, is, as a rule, completely removed; however, in many cases, especially when the balls were used on wet golf courses, very short grass residues remain sticking to the balls.

Furthermore, the surface of the plastic-laminated golf balls is highly stressed on account of the helical metal guiding device which leads the balls around the brush roller, and this will lead to a shorter service life of the golf balls.

Moreover, with such a conventional device, a fast rotation of the brush roller is necessary in order to ensure the required throughput of balls. This results in a high degree of stress on the mechanical parts of the device and on the bearings of the roller in particular, and therefore high-quality parts must be used, which causes high production costs as well as high maintenance and/or repair costs.

In addition, with such a device a great deal of cleaning work—especially for cleaning the brush roller—is involved. This is even more so the case with the U.S. Pat. No. 3,918,116 and USSR 882 490 as their brush arrangements are not self-cleaning and therefore clog up if grass and leaves accumulate.

The object of the invention therefore is to provide a device of the kind mentioned at the beginning which ensures that the balls are cleaned completely, in which the bristles are automatically cleaned by the high pressure of the jet, which reduces the stress upon the plastic-laminated surface of the golf balls when they are being cleaned, and which is comparatively simple in construction so that production and maintenance with reduced costs are possible.

This problem is solved by the features stated in the characterizing part of claim 1.

DRAWINGS

In the following, the invention is described in detail with reference to an embodiment shown in the drawings, wherein FIG. 1 shows a sectional view of a preferred embodiment of the invention FIG. 2 shows a cross-sectional view of the brush tube of the preferred embodiment from FIG. 1.

DETAILED DESCRIPTION

Figure 1:
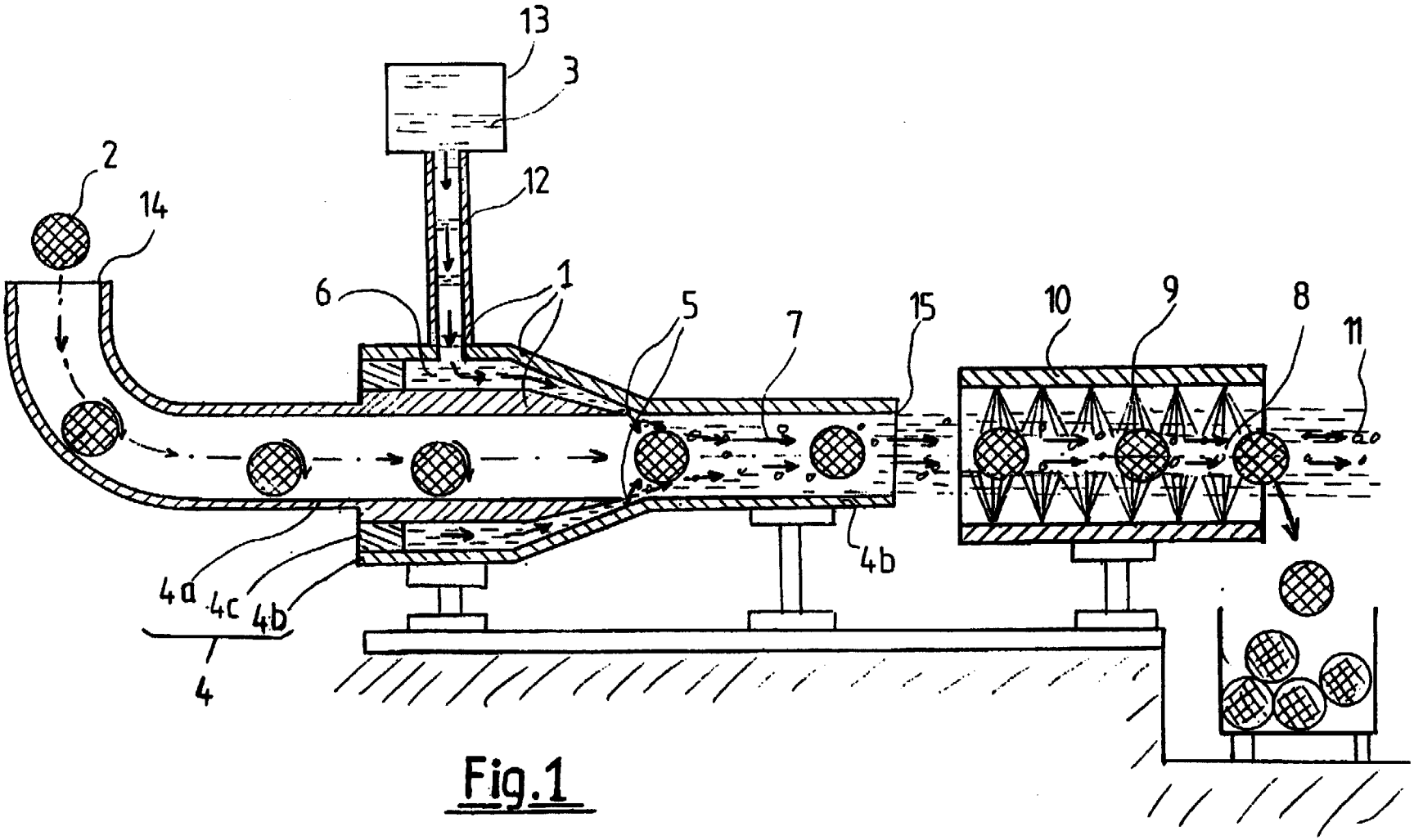

As shown in FIG. 1, a preferred embodiment of the present invention has a unit 1 for precleaning and accelerating the objects to be cleaned 2 (dirty golf balls, for example) as well as a brush tube 8.

The unit 1 includes a pump connection 12 and a tube 4 with two sections which are separated from each other; one section 4*a* is designed to accelerate the objects, and the other section 4*b* serves to further accelerate and preclean the objects. The space established due to the separation of these two sections is designed in such way that an annular opening/an annular nozzle 5 is formed.

A part of the first section 4*a* of the tube 4 is surrounded by a tubular chamber 6. This chamber 6 is additionally defined by a tubular outer wall 4*b* as well as by a chamber wall 4*c*.

In the preferred embodiment, the first section 4*a* of the tube 4, the chamber wall 4*c* as well as the second section 4*b* of the tube 4 form an integral construction. Both parts are—according to FIG. 1—connected with each other at the chamber wall 4*c* and the tubular outer wall 4*a* by means of external and internal threads, for example.

Figure 2:
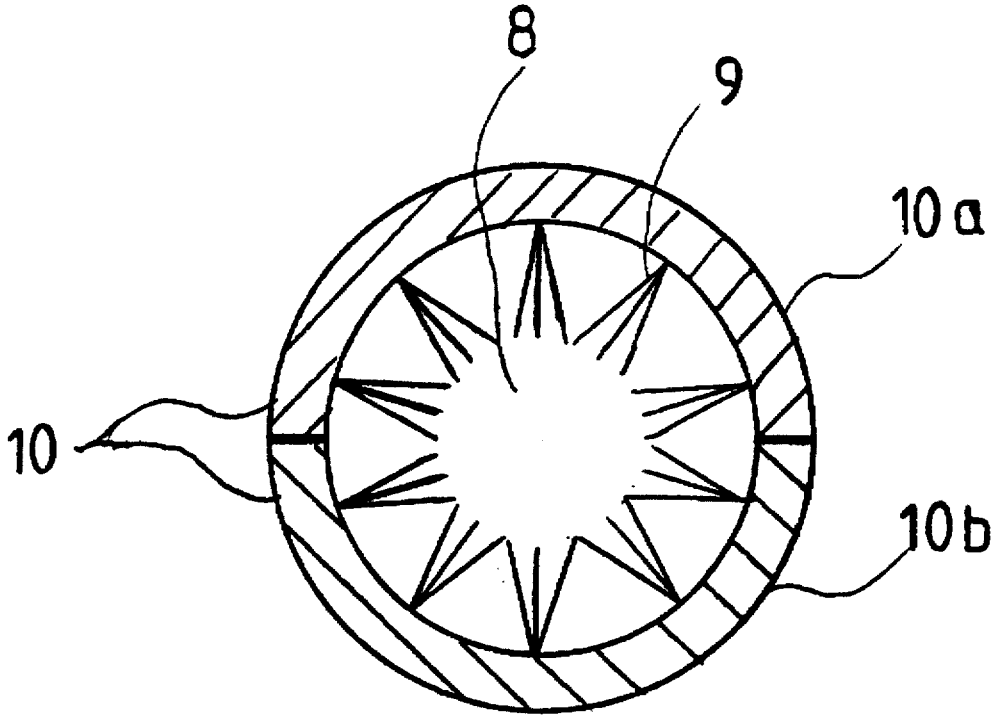

At the outlet 15 of the second section 4*b* of the tube 4, a brush tube 8 with a substantially annular cross section (FIG. 2) is coaxially joined. The brush tube has bristles 9 which are fixed to a tubular carrier 10 vertically to the axis of the brush tube. FIG. 2 shows an advantageous embodiment of the brush tube, in which the carrier 10 consists of two tube halves 10*a* and 10*b*.

The material used for the bristles 9 must be matched for the objects to be cleaned in such way that wear on the bristles as well as wear on the surface to be cleaned of the object 2 can be kept to a minimum. Bristles made of nylon, for example, are suitable for cleaning dirty golf balls.

In the following, the functioning of the device with reference to FIG. 1 for a single object to be cleaned—a dirty golf ball in particular—is explained.

By means of a pump 13, which is connected by the pump connection 12, a liquid or gaseous working fluid 3 is admitted into the tubular chamber 6 under pressure. This working fluid then flows through the annular opening 5 of the chamber 6.

The flowing velocity of the working fluid through the tubular chamber 6 is the result of the pressure at which the working fluid is injected. This fluid velocity is increased by the tapered shape of the end of the chamber, that is to say, with increased amount of taper—which means a reduced area through which the working fluid can effectively flow—the fluid velocity will increase. The working fluid will therefore reach the top fluid velocity when flowing through the annular opening 5.

According to the Bernoulli equation, an increase in fluid velocity will, in turn, result in a reduction of pressure/an increase in low pressure. By choosing a relatively large ratio between the area of the chamber 6 through which the working fluid effectively flows and the area of the annular opening 5 through which the working fluid also flows, there will be low pressure in the proximity of the annular opening 5.

This low pressure causes a heavy suction in the first section 4*a* of the tube 4, at the end of which, which is opposite to the annular opening 5, an atmospheric pressure prevails. With the help of this suction, the object 2 to be cleaned is then accelerated almost without friction in the direction of the opening.

When the object 2 leaves the region of the annular opening 5, it is caught by the jet 7 which escapes from the chamber 6 through the opening 5, and is thus further accelerated in the second section 4*b* of the tube 4.

In addition, the object 2 is precleaned by the escaping working fluid. This means that for example the dirt which has accumulated in the pimples of the golf balls and has become hard is loosened and already partly washed away.

After leaving the second section 4*b*, the object 2 enters the brush tube 8. With the help of the bristles 9 which reach into the travelling path of the object 2, the latter is finally cleaned. This cleaning effect is additionally increased by the working fluid which escapes from the unit 1 and flows through the brush tube 8. Now the dirt still sticking to the object, e.g. short grass residues sticking to the golf balls, is brushed off and is additionally washed down by the jet 7.

In order to ensure a complete cleaning of the globular object 2, the latter must already have a moment of momentum when entering the device 1. An initial moment of momentum of the object can, for example, be obtained by leading the object 2 into the device through the opening 14 by means of a bent tube.

In order to make it possible for the object 2 to leave the device in FIG. 1 completely, the dimensions of the unit 1 for acceleration must be planned in such way that the object, when leaving at the outlet 15, will travel at a speed which enables it to completely travel through the brush tube 8.

The throughput of balls through the entire device in FIG. 1 is primarily determined by the acceleration power of the unit 1. The acceleration power in turn depends primarily on the low pressure generated near the annular opening 5; the higher the low pressure (or, in other words, the lower the pressure) is in this region, the higher the acceleration power will be.

The low pressure can—as has already been mentioned—be increased by increasing the fluid velocity of the working fluid in the proximity of the annular opening 5. This can be effected by increasing the throughput of working fluid, e.g. by using a more efficient pump 13.

The increase in throughput of working fluid does not only lead to an improved acceleration power but also to an improved cleaning performance in the second section 4*b* of the tube 4 as well as in the brush tube 8 through which the working fluid flows.

However, limits are set for such a seemingly limitless improvement of the acceleration power and cleaning performance: on the one hand, for physical reasons it is not possible to generate a low pressure which is lower than the steam pressure of the working fluid used, and on the other hand such an improvement would considerably push up the production costs of the device. Especially an increase in the power of the pump leads to a disproportionate increase in production costs.

Depending on the type of objects to be cleaned, a compromise must be made between cleaning performance, throughput of objects to be cleaned, and production costs.

In the case of the objects being golf balls, experiments have shown that it is a very good compromise to bring a liquid working fluid into the tubular chamber 6 under a pressure of approximately 3–6 bar.

Conventional tap water can be used as a working fluid for the device.

Depending on the nature of the objects to be cleaned or on the demands made on the cleaning power, gases or gas mixtures can also be used.

Furthermore, in order to avoid excessive environmental pollution it is possible with the device according to the invention to collect the working fluid and to repeatedly feed it to the device by means of the pump 13. A filter unit for cleaning the working fluid 3 prior to its reutilization can be installed so that in this embodiment the pump, the tubular chamber 6 and the area around the opening 5 do not get dirty by the used working fluid 3.

By means of the precleaning process according to the invention in the second section 4*b* of the tube 4 and the following cleaning process in the brush tube 8, on the whole an increased cleaning performance is achieved as against the prior art. The grass residues sticking to the golf balls in particular are removed with the help of the device according to the invention.

The almost frictionless acceleration of the object 2 in the first section 4*a* of the tube 4 as well as the acceleration in the flowing working fluid furthermore reduce wear on the plastic-laminated surface of the golf balls to be cleaned, which means that the golf balls will have a longer service life compared to that given by known cleaning devices.

In addition, the acceleration in the unit 1 according to the invention in FIG. 1 also ensures a throughput of balls which corresponds to the throughput of prior art devices.

The comparatively simple construction of the device as against the prior art also guarantees less production costs and less maintenance costs.

I claim:

1. Device for cleaning and accelerating globular objects, especially golf balls, comprising:

a.) means for accelerating and precleaning the objects, said means being a unit which is configured to develop, by using a working fluid which is fed under pressure, a pressure difference whereby the object being cleaned is accelerated in a first direction, said unit having an inlet and an outlet, said unit further including an annular nozzle portion between the inlet and the outlet wherein said working fluid contacts the object being cleaned in form of a jet, washes it for precleaning purposes and at the same time sweeps the object being cleaned into the direction of the outlet by means of said jet; and b.) an elongated brush tube which is disposed downstream of said unit and adjacent the outlet thereof, said brush tube further being generally aligned with the unit and the first direction, said brush tube including a plurality of annularly arranged bristles extending from an interior wall thereof, contacting the object to be cleaned and loosening and removing the remaining dirt sticking to the object after it has passed from said unit, said jet of said working fluid flowing through said brush tube, and said jet washing away said dirt from the objects to be cleaned and from said bristles, the velocity given the object to be cleaned by the unit being such that it passes entirely through said brush tube, after which said object may be collected.

* * * * *